United States Patent [19]

Korzeniewski

[11] 4,218,030

[45] Aug. 19, 1980

[54] WEB FEED MECHANISM

[75] Inventor: Eugene C. Korzeniewski, Willingboro, N.J.

[73] Assignee: Avery International Inc., San Marino, Calif.

[21] Appl. No.: 61,478

[22] Filed: Jul. 27, 1979

[51] Int. Cl.[2] ..... B65H 17/02

[52] U.S. Cl. ..... 242/67.2; 242/67.3 R

[58] Field of Search ..... 242/67.2, 67.1 R, 67.3 R, 242/75.43, 75.4, 75.44

[56] References Cited

U.S. PATENT DOCUMENTS

| | | | |
|---|---|---|---|
| 1,606,123 | 11/1926 | Hermann | 242/67.2 |
| 3,094,295 | 6/1963 | Ward | 242/67.2 |
| 3,284,017 | 11/1966 | Merrill | 242/67.2 X |
| 3,555,774 | 1/1971 | Craig | 242/67.2 |
| 3,967,789 | 7/1976 | Deletzke | 242/67.3 R |

*Primary Examiner*—Edward J. McCarthy

*Attorney, Agent, or Firm*—Christie, Parker & Hale

[57] ABSTRACT

There is described a web feed mechanism having a first drive means that engages the web and urges the web longitudinally in one direction. A second drive means engages the web at a position spaced from the first drive means and upstream thereof, the second drive means including a stepper motor which primarily acts as a brake to lock the web against movement by the first drive means. To advance the web, the stepper motor is stepped through a predetermined number of incremental steps, allowing the web to be advanced a fixed distance by the first drive means.

10 Claims, 5 Drawing Figures

WEB FEED MECHANISM

FIELD OF THE INVENTION

This invention relates to web feed mechanisms, and more particularly, to a web feed mechanism that advances the web in controlled steps of accurately controlled length.

BACKGROUND OF THE INVENTION

There are a number of applications for a web feed mechanism in which a web material, such as paper, fabric, foil, or the like, must be advanced in controlled steps, each step representing an accurately defined length of the web material. For example, in the labeling and printing arts a continuous web or foil is advanced in unit lengths during an imprinting or die cutting, or other stamping operation, to form a plurality of individual labels or other repetitive lengths of material. Starting, advancing and stopping the web without breaking the web and at the same time controlling the incremental lengths of web to a close tolerance has been a problem. Accuracy and speed require the web to be accelerated and decelerated very rapidly without exceeding the tensile strength of the web material. High torques are required while maintaining inertial loads to a minimum.

The stepper motor has been used as a drive mechanism for advancing web material in controlled steps because the stepper motor can be advanced in accurately controlled angular increments, and because the stepper motor provides substantially full torque when it is not rotating or stepping, thus providing a braking effect. However, stepper motors having sufficient torque to both accelerate and decelerate the foil or web, as well as to accelerate and decelerate the drive mechanism, presents difficulties in the size and cost of the stepper motor and the power capacity of the associated stepper motor control.

SUMMARY OF THE INVENTION

The present invention is directed to an improved web driving mechanism utilizing a stepping motor to index the advance of the web while providing the torque for advancing the web from a separate conventional torque motor drive. Thus, according to the present invention, a conventional torque motor is the principal source of power for applying tension to the web and for pulling the web from the supply roll and through the operational zone in which the imprinting, die cutting, or the like takes place. Indexing of the feed mechanism to advance the web in fixed incremental lengths is provided by a stepper motor and drive mechanism engaging the web connected to the stepper motor at a point upstream of the torque motor drive. When energized, the stepper motor locks the web against movement by the torque motor drive, thus keeping the web under tension in the operational zone. By pulsing the stepping motor a predetermined number of times, the web is advanced by the torque motor in a predetermined number of accurately controlled incremental steps.

BRIEF DESCRIPTION OF THE DRAWINGS

For a better understanding of the invention, reference should be made to the accompanying drawings, wherein.

DETAILED DESCRIPTION

Figure 1:
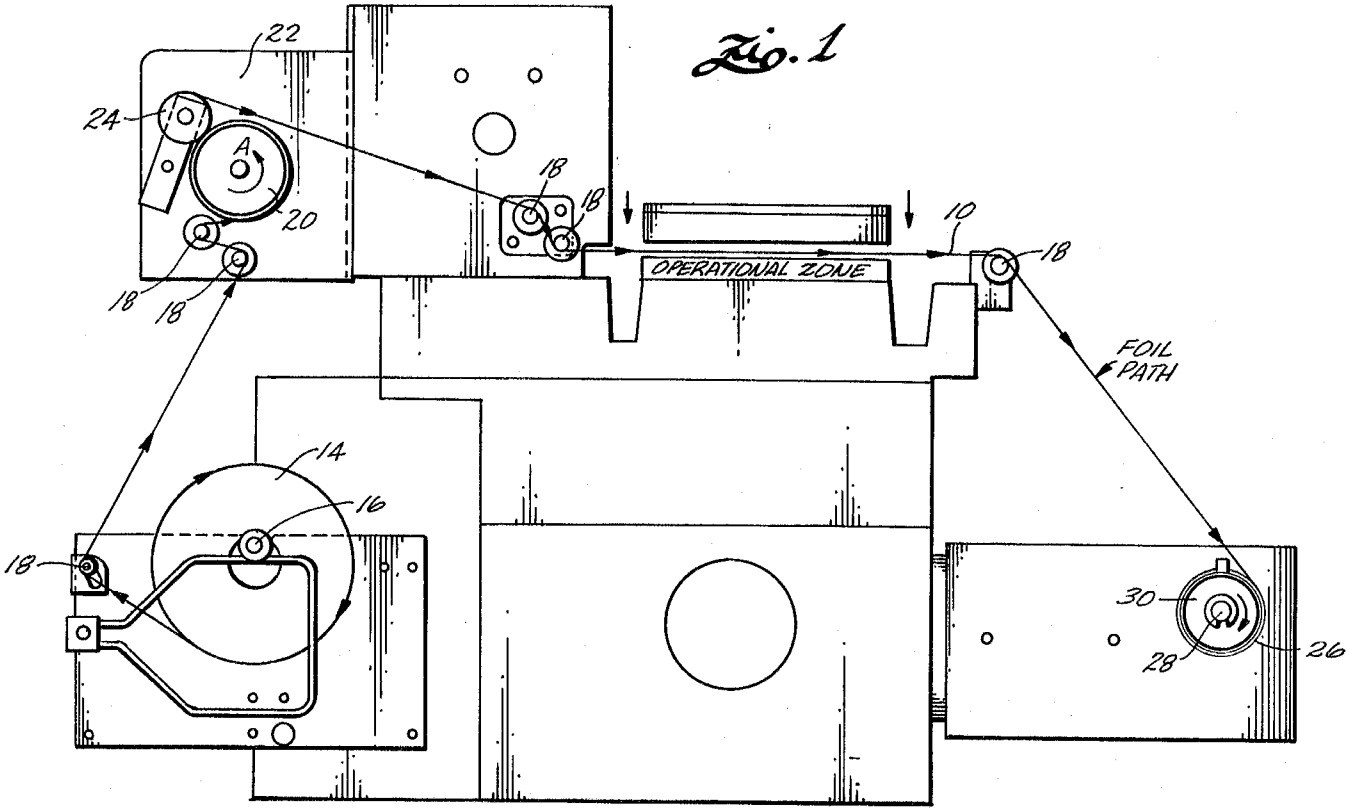
FIG. 1 is a side elevational view of a machine incorporating the web feed mechanism of the present invention.

Referring to FIG. 1, there is shown a typical machine incorporating a web feed mechanism for advancing a web through an operational zone in incremental steps. The web, indicated at 10, is stopped momentarily in the operational zone while it is stamped imprinted, die-cut, or the like, before advancing to bring a new length of web into the operational zone.

Typically, the web material is loaded into the machine in the form of a supply roll 14 rotatably supported on arbor 16. The web 10 is directed through a series of guide rollers 18 into engagement with the periphery of a first drive roller 20. The drive roller 20 is controlled by a stepper motor drive, indicated generally at 22, hereinafter described in detail in connection with FIGS. 2–4. A spring loaded pinch roller 24 secures the web in contact with the surface of the drive roller 20 while permitting easy threading of the webbing through the machine.

The webbing is directed through the operational zone by additional guide rollers 18 and onto a take-up roll 26. The take-up roll is journaled on a spindle 28 and is rotated by a suitable take-up motor 30 which supplies continuous torque to the take-up roll 26. The take-up motor applies tension to the web 10 through the operational zone to the drive roller 20. This tension is sufficient to pull the web through the operational zone when stepping of the stepper motor allows the web to advance, but is insufficient to pull the web through the operational zone when the stepping motor is energized but not being stepped.

Figure 2:
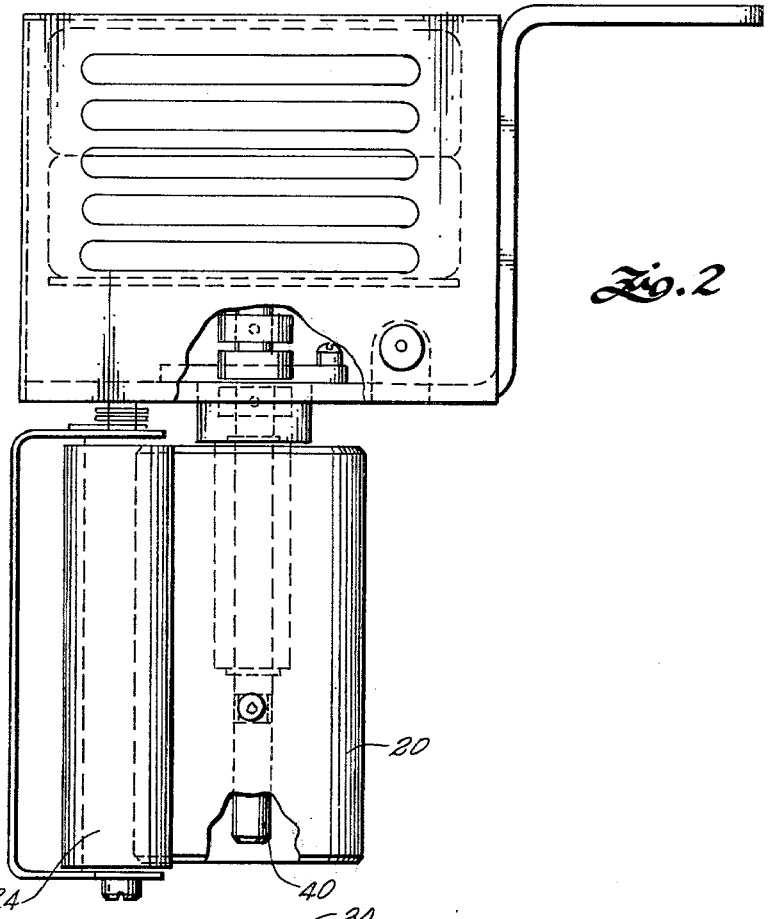
FIG. 2 is a top view of the stepper motor drive mechanism of the present invention.
Figure 3:
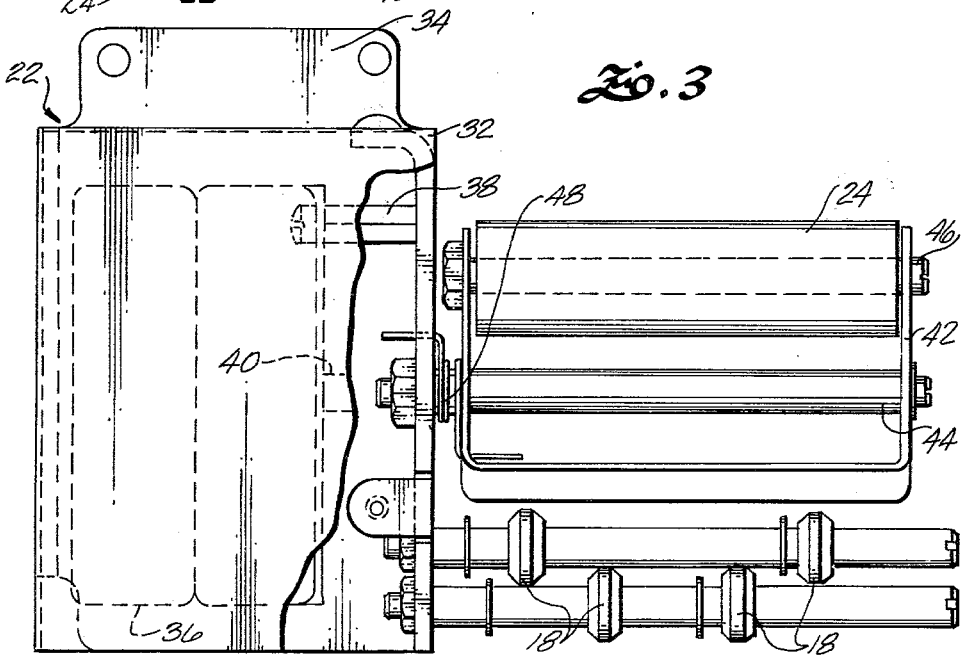
FIG. 3 is a side view of the stepper motor drive.
Figure 4:
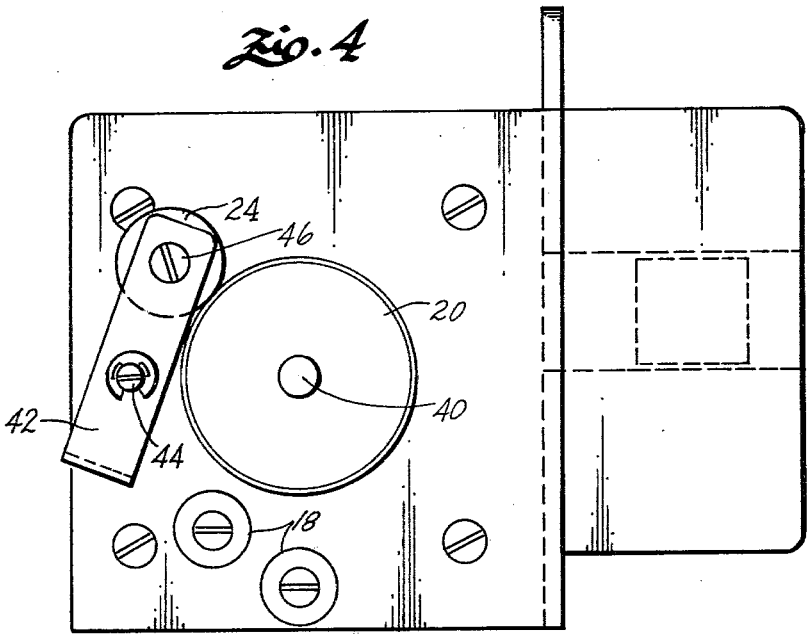
FIG. 4 is an end view of the stepper motor drive.

The stepping motor drive is shown in more detail in FIGS. 2–4. The stepping motor assembly includes an outer housing and frame assembly 32 adapted to be secured to the machine frame by a suitable mounting flange 34. A stepper motor 36 is secured in the housing 32 by suitable mounting lugs 38. The output shaft of the stepper motor, indicated at 40, extends out of the housing, the outer end of the shaft 40 supporting the drive roller 20.

The pinch roller 24 is supported from the housing 32 by a U-shaped bracket 42 journaled on a supporting spindle 44 secured to and projecting from the housing 32 along an axis parallel to the axis of the motor shaft 40. The pinch roller 24 is journaled on a shaft 46 supported at the outer end of the U-shaped bracket 42. A coil spring 48 extending between the bracket 42 and the housing 32 causes the bracket to rotate about the spindle 44 in a direction to urge the pinch roller 24 against the drive roller 20.

Figure 5:
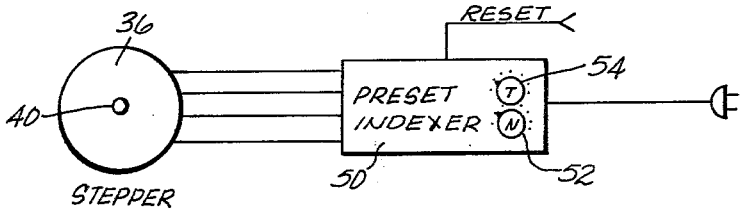
FIG. 5 is a stepper motor control.

The stepper motor 36 is a conventional commercially available motor, such as described, for example, in U.S. Pat. No. 3,286,109. The stepper motor is an induction type motor usually having a permanent magnet rotor and four phase windings. When any of the windings is energized, the rotor is locked in position magnetically. By switching energization from one phase winding to the next, the motor can be stepped through a predetermined fixed increment, e.g. 7.5° degrees. By pulsing the windings in sequence a predetermined number of times, the motor can be advanced in a corresponding number of incremental steps. As shown in FIG. 5, the stepper motor is controlled by a preset indexer circuit 50. Such preset indexer circuits are commercially available and allow the stepper motor to be advanced in a preset number of steps N at a rate T steps per second. The value of N and T can be preset by controls on the indexer, such as indicated at 52 and 54. By fixing the number of steps, the total angular advance of the stepper motor can be accurately controlled. Indexer circuits typically allow the stepping motor to be advanced in any selected number of steps up to a maximum of 99,999, for example. Stepping rates up to 500 steps per second are provided by such preset indexers. The indexer can be reset to start a new indexing cycle by applying a reset pulse externally to the indexer. The reset pulse may be derived, for example, from a timer or may be derived from the stamping or other mechanism associated with the operational zone of the machine. Thus by setting the values of N and T, the stepping motor 36 controls the length of the web pulled from the supply roll 14 by the take-up motor 30 with each reset cycle.

It will be seen that the present invention has the advantage that the principal source of driving torque for advancing the web through the machine is derived from the take-up motor 30. Relatively little starting torque is required of the stepping motor since it operates primarily as a brake against the tension applied to the web 10 by the take-up motor 30. The system can be made to have sufficient start-up torque to overcome the drag load imposed in accelerating the web and pulling it through the operational zone.

What is claimed is:

1. A web feed mechanism having an adjustable intermittent drive for transferring the web from a supply roll, comprising:

a first drive means engaging the web on one side of the operational zone, second drive means engaging the web at a position spaced from the first drive means on the other side of the operational zone, motor means applying torque to the first drive means in a direction to pull the web from the supply roll past the position of the second drive means and through the operational zone, means including a stepper motor controlling rotation of the second drive means, the stepper motor when energized locking the second means against rotation and preventing movement of the web by the first drive means and associated motor means, and control means for pulsing the stepper motor to advance the second roller in fixed angular increments, allowing the web to be advanced in fixed increments by the first drive means and associated motor means.

2. Apparatus of claim 1 wherein the first drive means includes a take-up roll on which the web is wound, the first motor means applying torque to the take-up roll in a direction to put the web under tension.

3. Apparatus of claim 1 wherein the second drive means further includes a drive roller and a pinch roller for clamping the web to the surface of the drive roller.

4. Apparatus of claim 3 wherein the stepper motor is directly connected to the drive roller whereby the roller and stepping motor rotate as a unit.

5. Apparatus of claim 3 wherein the first drive means includes a take-up roll on which the web is wound, the first motor means applying torque to the take-up roll in a direction to put the web under tension.

6. Apparatus of claim 1 wherein the control means energizes the stepping motor to lock the stepping motor against rotation and pulses the stepping motor to index the rotation of the stepping motor by a predetermined number of steps to control the distance the web is moved by the first drive means.

7. Apparatus for advancing web material in steps of predetermined length, comprising means applying tension to the web for pulling the web material along a predetermined path, brake means engaging the web upstream of the tension applying means for locking the web against movement by the tension applying means, means releasing the brake means to permit the web to be moved by the tension applying means, and indexing means for energizing the brake means when the web has moved a predetermined distance.

8. Apparatus of claim 7 wherein the brake means includes a stepper motor, a roller engaging the web, and means connecting the stepper motor to the roller.

9. Apparatus of claim 8 wherein the indexing means includes means pulsing the stepping motor a selectable number of times to advance the stepping motor, roller, and web a predetermined number of fixed incremental steps.

10. Apparatus of claim 9 further including a pinch roller for releasably engaging the web with the surface of the roller.

* * * * *